United States Patent [19]

Kirchhoff

[11] 4,363,394

[45] Dec. 14, 1982

[54] APPARATUS FOR CONVEYING ROLLED STOCK

[75] Inventor: Hans Kirchhoff, Krefeld, Fed. Rep. of Germany

[73] Assignee: Schloemann-Siemag Aktiengesellschaft, Dusseldorf, Fed. Rep. of Germany

[21] Appl. No.: 94,773

[22] Filed: Nov. 16, 1979

[30] Foreign Application Priority Data

Nov. 18, 1978 [DE] Fed. Rep. of Germany ..... 2850174

[51] Int. Cl.[3] ..... B65G 47/10

[52] U.S. Cl. ..... 198/369; 72/14; 72/419; 198/436; 198/782

[58] Field of Search ..... 72/200, 201, 202, 250, 72/251, 228, 14, 419; 198/369, 436, 782, 448; 193/36, 31 A

[56] References Cited

U.S. PATENT DOCUMENTS

| | | | |
|---|---|---|---|
| 1,741,616 | 12/1929 | Crady | 198/369 X |
| 2,711,809 | 6/1955 | O'Keefe et al. | 72/14 X |
| 3,103,271 | 9/1963 | Christiansen, Jr. | 193/36 X |
| 3,115,961 | 12/1963 | Layton, Jr. | 193/36 |
| 3,223,345 | 12/1965 | Hill . | |
| 3,523,618 | 8/1970 | Nielsen | 198/351 X |
| 4,250,729 | 2/1981 | Berz | 72/251 |

FOREIGN PATENT DOCUMENTS

| | | | |
|---|---|---|---|
| 721896 | 3/1969 | Belgium . | |
| 1249801 | 9/1967 | Fed. Rep. of Germany | 72/251 |
| 1279591 | 10/1968 | Fed. Rep. of Germany . | |
| 1303626 | 6/1972 | Fed. Rep. of Germany . | |
| 1328186 | 4/1963 | France . | |
| 257299 | 8/1926 | United Kingdom | 193/36 |

*Primary Examiner*—Francis S. Husar
*Assistant Examiner*—Carl J. Arbes
*Attorney, Agent, or Firm*—Holman & Stern

[57] ABSTRACT

Rolled stock is conveyed from two side-by-side rolling mills to two cooling beds. Stock can be conveyed from each mill to either one or the other of the cooling beds. Two swingable rollerway sections are provided in each rolled stock line connecting the mills and the cooling beds. These sections can be swung out to transfer stock from one rolled stock line to the other.

9 Claims, 8 Drawing Figures

16
16a
S
15
15a
Ia
IIa
I
II
B1
B2
5
5a
3
3a
R
β
α1
α2
25
25a

APPARATUS FOR CONVEYING ROLLED STOCK

FIELD OF THE INVENTION

The invention relates to apparatus for conveying rolled stock from two side-by-side rolling lines to associated cooling beds. The apparatus makes it possible for stock from either of the rolling lines to be conveyed to either one of the cooling beds.

DESCRIPTION OF THE PRIOR ART

The German patent specification No. 1,249,801 discloses a rolling train for high grade and medium grade steel with a wide rolling program in respect of shape of profile and dimensions of the profiled cross-section in the so-called multiple line arrangement (German patent specification No. 1,057,048). A very long rollerway is provided between rolling trains in two approximately parallel rolling lines and the respective cooling beds associated therewith. The rollerway is made up of an exit rollerway section, in both rolling lines and a swingable gate section. The two gate sections are controllable together or independently of each other in respect of the swing movement.

It is possible thereby during twin strand rolling, i.e. simultaneous rolling operation in both rolling lines, to always supply one cooling bed, or during single strand rolling in only one rolling line to supply alternately the one or the other cooling bed with partial lengths.

Twin strand rolling supplying one cooling bed will normally be carried out with relatively thin, flexible stock. Single strand rolling supplying both cooling beds will normally be carried out with relatively thick, non-flexible stock.

When the gate section is swung from one rollerway to the other in single core rolling operation for alternating charging of both cooling beds, a bend in the conveying path will necessarily occur in the rolling line, and the rolled stock must pass around this bend. The head ends and the tail ends of each stock length may be bent as the lengths pass the bend in the path, depending upon the conveyance speed, and this may lead to disturbances in the operation, and damage to the stock lengths.

Furthermore, in view of the large masses to be shifted, the swing gate is only able to perform these swinging movements slowly, so that prolonged periods of pause have to be allowed between the successively following lengths which are to be fed to alternate cooling beds.

BRIEF SUMMARY OF THE INVENTION

It is an object of the invention to improve the transfer conditions for trouble-free transfer of stock lengths via the pivotally-movable part of the rollerway during single strand operation and during alternating charging of the two cooling beds.

It is another object of the invention to ensure in an operationally reliable manner alternating charging even when the partial lengths follow directly after each other.

A further object of the invention is to provide an adjustment between the feed planes of the rollerway and of the pivotally-movable rollerway sections, to avoid a change of direction of the rolled stock as it passes onto the pivotal rollerway section.

It is a further object to provide a short swing path during change-over of the rollerway section from one rolling line to the other, in order to permit the change-over to be performed within a short time within the succession periods of the successively following stock lengths, and not only in the pause periods between feeding of one slab and the next to the rolling mills.

According to the invention, there is provided a conveying apparatus for conveying rolled stock from two side-by-side rolling mill trains to two cooling beds, the apparatus comprising two rolled stock lines also arranged side-by-side and extending between the rolling mills and the cooling beds, two sequentially arranged rollerway sections in each stock line, and means for swinging said sections laterally relative to the direction of travel of rolled stock from the rolling mills to the cooling beds in order to transfer stock from one stock line to the other and to convey the rolled stock to one or other of the cooling beds.

In a preferred embodiment the swingable rollerway section is constructed in the form of a tipping rollerway which, at the cooling bed end, may be swung into one or the other rolling line selectively in line with the head ends of the entry rollerways, by means of a tipping movement directed laterally in respect of the feed direction, along an arcuate path out of a middle position relatively to its stationary end at the inlet, while being twisted and deflected from its longitudinal axis about a pivot axis which is inclined downwardly relatively to the latter along the feed direction.

It is an advantage of such apparatus that the laterally swingable rollerway section or the tipping rollerway, respectively can be moved extremely quickly and with a very short stroke path into the one or the other rolling line of the pivotally-movable entry rollerway associated with each cooling bed, so that the successive partial lengths are fed alternately to the one or the other cooling bed. At the same time impact locations caused by a change of direction of the rolled material at the transfer points between supply rollerway and entry rollerway are avoided, so that the rolled material is guided calmly and operationally reliably into the respective rolling line. It is attained furthermore that, in consequence of the radial tipping movement of the tipping rollerway, the feed plane of the tipping rollerway, in respect of its inclination, lies always in line with that of the associated pivotally-movable entry rollerway at the transfer location of the respective partial length, whereby a smooth operationally reliable travel of the partial lengths is ensured. Finally the change-over of the tipping rollerway into the respective rolling line may be effected with an extremely small short-stroke change-over movement.

In a further embodiment of the invention the inclination of the feed plane of the entry grooves of the entry rollerways and the inclination of the feed plane of the entry grooves of the preceding tipping rollerways are constructed to be flush with each other at the respective transfer points in the respective operative position. The angle of inclination of the entry grooves of the pivotally-movable entry rollerways as well as the tipping rollerways in the respective operative position amounts to approximately 10° towards the respective cooling bed end relatively to the horizontal plane. The rolling train end of the tipping rollerway in the rolling line is arranged in stationary support bearings. The tipping path of the tipping rollerway at its cooling bed end for the purpose of swinging into the alignment line of the one or the other entry rollerway out of the perpendicular centre position relatively to the pivot axis occurs symmetrically to either side by the magnitude of the deflection path towards the head end of the one or the other entry rollerway. The rolled material guides in each rolling line from the rolling train to the head end of the entry rollerway of each cooling bed are disposed extending towards each other in such a manner that the extension thereof is always directed to the entry guidance of the cooling bed of the other rolling line. Thereby, during single core rolling, impact locations of any kind are avoided in the guidance of the rolled material at the transfer points. The control of the swing movement of the entry rollerways and/or the swinging-out movement of the tipping rollerways is effected by electrical sensors which are arranged along the conveyor rollerways preceding the rolling train end, dependent upon the gaps between the partial lengths by speed-dependent or time-dependent controlled delay means by means of hydraulic or similar power means. Alternatively the control may occur dependent upon the cutting signal of the parting shears. Having a horizontal feed plane, the tipping rollerway is supported along its length on stilts which are arranged in a vertical plane. The tipping rollerway may be swung out laterally across the feed line. A common downwardly inclined alignment line may connect the pivot axes of the stilts. The length of the stilts increases along the length of the tipping rollerway in the feed direction continuously in such a manner that upon swinging the tipping rollerway through the lateral stroke path, a swinging-out movement occurs approximately on the periphery of a cone surface the longitudinal axis of which forms a downwardly inclined alignment line which connects together the axial bearings of the stilts. The pivot axes of the stilts (support bearings) of the tipping rollerway towards the entry rollerway are disposed, offset in height, by the amount of the continuous increase of the length of the stilts in steps relatively to the horizontal plane parallel to the rolling line, downwards in the feed direction along a common downwardly inclined alignment line.

For the purpose of charging both cooling beds with successively following partial lengths in single core operation, two alternative constructions, with different methods of operation are proposed.

In the one manner of operation, with a relatively long tipping rollerway, the pivotally movable entry rollerway of the other rolling line is moved accurately towards the other pivotally movable entry rollerway into the operative position prior to the start of the operation, the alternating transfer of the partial length to the one or the other cooling bed being effected merely by the sensor control by means of the swinging-out movement of the tipping rollerway.

In the other manner of operation, with a relatively short tipping rollerway, the pivotally movable entry rollerway of the other rolling line is moved prior to the start of the operation, as close as possible to the one pivotally movable entry rollerway and, for the purpose of transferring the partial lengths alternatingly to the one or the other cooling bed. At each transfer of a partial length to the entry rollerway the sensor control is operated, and actuates a swing movement of the tipping rollerway into the operative position as well as also an additional relative swing movement of the entry rollerway of the other rolling line, the latter swing movement being directed towards the operative position of the tipping rollerway, wherein simultaneously a similarly directed outward deflection of the one entry rollerway by the same amount of the relative swing movement of the other entry rollerway occurs laterally in the same swing direction.

BRIEF DESCRIPTION OF THE DRAWINGS

Further features and advantages of the invention will be apparent from the accompanying drawings which illustrate, by way of example, some embodiments of the invention. In the drawings.

DETAILED DESCRIPTION

Figure 1:
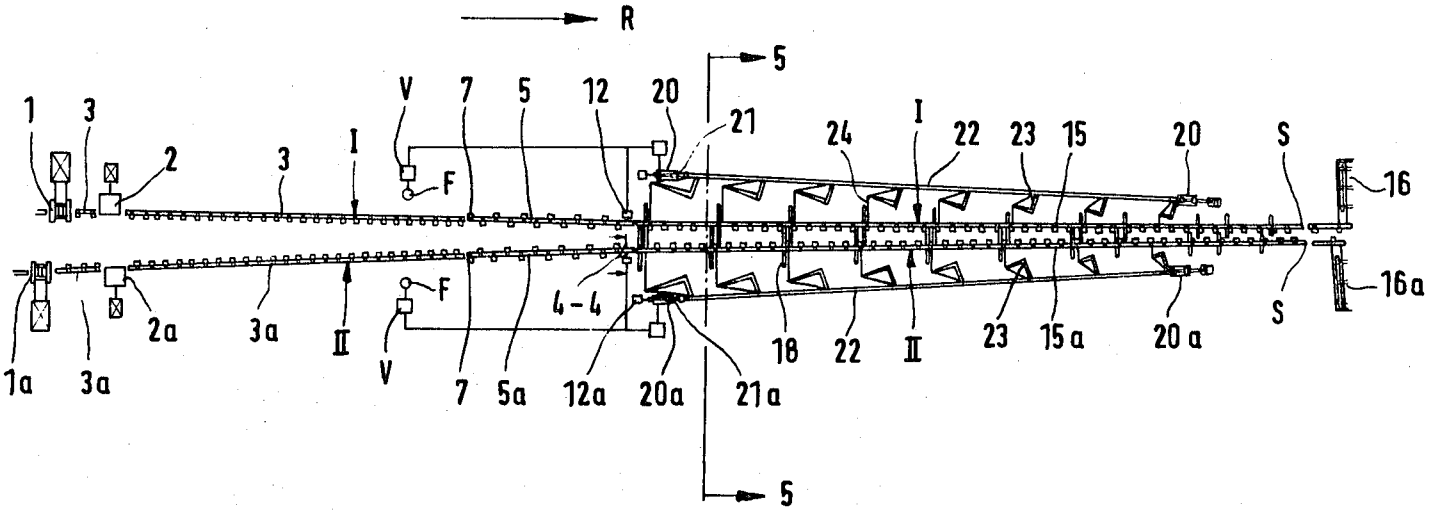
FIG. 1 is a plan view of a general arrangement of an installation for two-strand rolling operation.

In FIGS. 1, 3, 4 and 5, finish rolling strands 1, 1*a* disposed in two approximately parallel rolled stock lines I and II are part of a preceding rolling train of high grade and medium grade steel sections. The rolling train has rolling mill groups which are arranged mutually in parallel, but offset. The rolling mills are two-high rolling mills with grooved rolls which, dependently upon the rolling programme, are always arranged one behind the other mutually offset by 90°. The configuration of the rolling train is known for example as a so-called multiple line arrangement or as a rolling train with two approximately parallel rolling lines and permits a wide rolling program to be rolled simultaneously either in both rolling lines or only in one rolling line. Rolled stock of a wide variety of cross-sections and dimensions, of flexible and relatively bending-resistant rolled material can be produced. The cross-sections comprise substantially round profiles of from 8 to 70 mm diameter, square sections of from 8 to 70 mm edge length, hexagonal and octagonal sections having an across flats dimension of from 8 to 70 mm, flat sections having a width of from 12 to 150 mm, isosceles angle sections with an edge length of from 16×16 mm to 90×90 mm as well as angle sections with dissimilar limbs having an edge length of from 30×20 mm to 100×70 mm, U-sections of from 30×20 to 100×40 mm. T-sections with a height of from 20 to 80 mm, as well as double T-sections with a width of up to 100 mm.

For the thinner, flexible stock, so-called two strand rolling simultaneously in the two rolling lines is possible with the stock being fed via rolled stock lines I and II to a respective associated cooling bed 16 or 16*a*, respectively. For thicker, relatively bending-resistant stock, single strand rolling in either rolling line is possible, in which case both cooling beds are alternately charged with stock lengths.

The finishing rolling mills 1, 1*a* are each associated with a rotating cropping and parting shear 2, 2*a* in fixed conveyor rollerway sections 3, 3*a*. The parting shears 2, 2*a* crop the rolled stock and divide it into lengths suitable for the cooling bed. The conveyor rollerway sections 3, 3*a* are followed in the lines I and II by a relatively short tipping rollerway section 5, 5*a* the length of which amounts to approximately 10 to 20 m. The actual length is determined by the cooling bed length and the maximum rolling speed.

Figure 3:
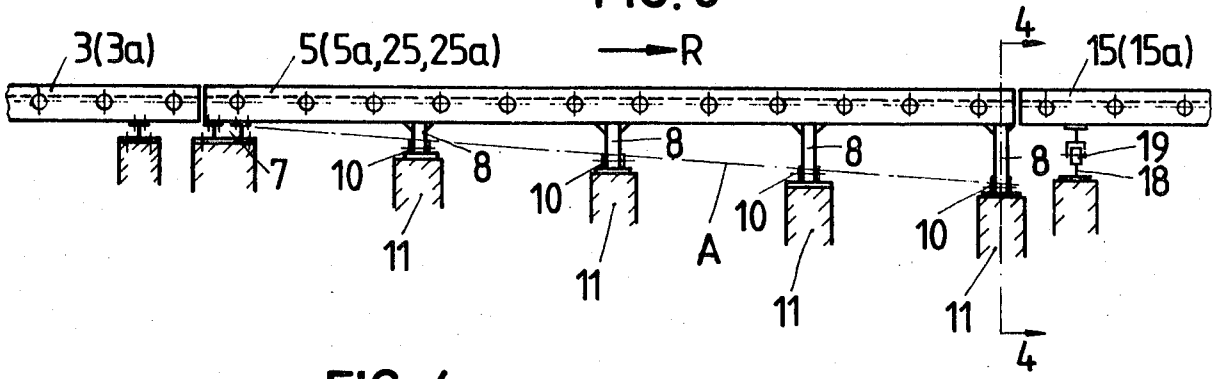
FIG. 3 is a side elevation view of a pivotal rollerway section, in the swung-out position.
Figure 4:
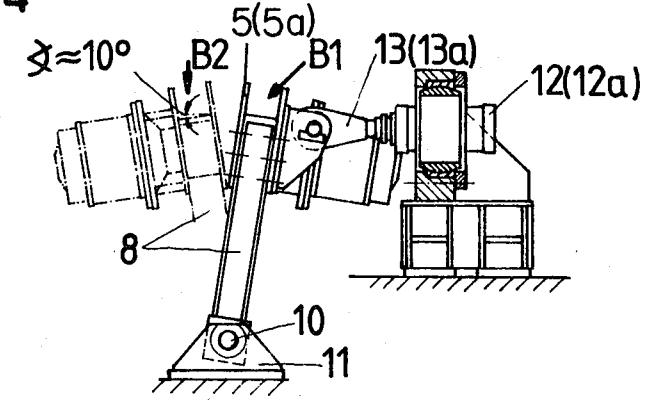
FIG. 4 is a cross-section through the rollerway section on the section taken line 4—4; of FIG. 3

As shown by FIGS. 3 and 4, the tipping rollerway section 5, 5*a* is fixed at the upstream end to a stationary bearing 7 and is supported over its length on struts 8 which are pivotally movable about horizontal axes 10. The struts 8 have a length which increases steadily in the feed direction R, with the supports 11 of the axes 10 being downwardly offset in height in a step-like manner along a common alignment line A which is inclined and acts as a swing axis. The tipping rollerway section 5, 5*a* is pivotally movable to either side from its vertical centre position into either one of the operative positions B1 or B2 (see FIG. 4) by means of a hydraulic or pneumatic power means 12, 12*a* which is arranged at the downstream end of the rollerway section. The piston rods 13, 13*a* of the power means 12, 12*a* are pivotally connected to the tipping rollerway section 5, 5*a*. Thereby the swing movement occurs on an arcuate path approximately along the periphery of a cone surface the longitudinal axis of which lies along the alignment line A, which path may extend even further below the fixed bearing 7, but is not illustrated further. The tipping rollerway section 5, 5*a* can be swung out laterally into alignment with one or the other of the lines I or II from its fixed bearing 7 in an arcuate swinging motion. Owing to the swing movement of the outlet end of the tipping rollerway section 5 or 5*a* into the end positions B1 or B2, there occurs in single strand rolling operation an alternate transfer of the successively following stock lengths either into the outlet rollerway section 15 with the cooling bed 16 following therebehind, or into the outlet rollerway section 15*a* with the cooling bed 16*a* following therebehind. The tipping rollerway sections 5, 5*a* as well as the rollerway sections 15, 15*a*, and likewise the remainder of the rollerways 3, 3*a* possess rollerway rollers with individual drive, but the drives of the tipping rollerway sections 5, 5*a* and those of the pivotal rollerway sections 15, 15*a* are disposed offset one to the other, in order that the rollerway sections may be positioned as closely together as possible.

Figure 5:
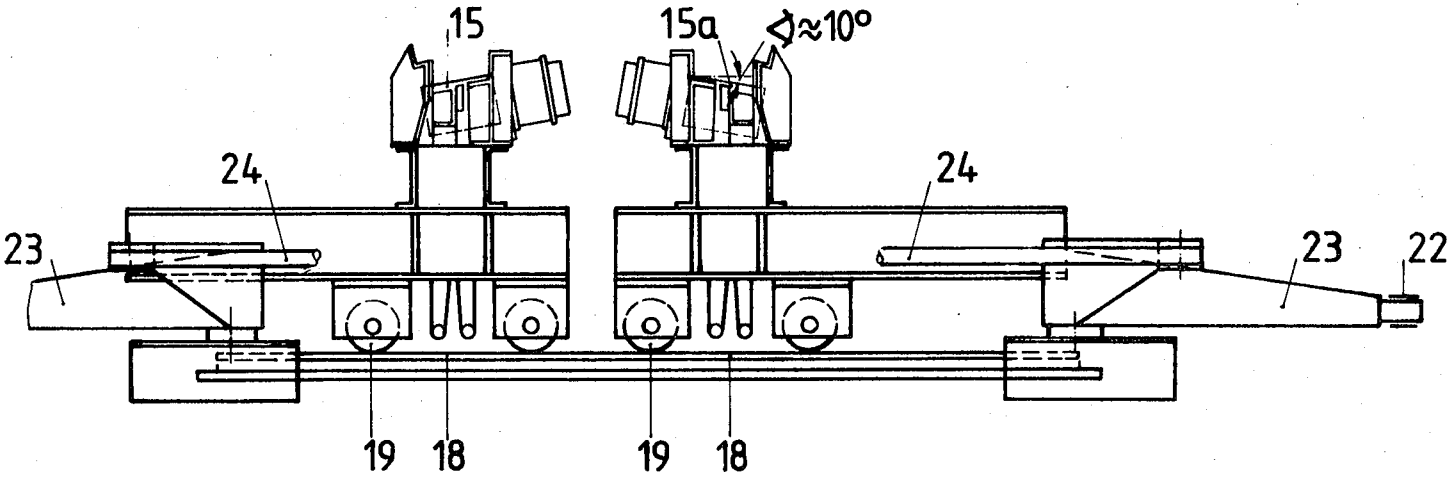
FIG. 5 is a cross-section through a second pivotal rollerway section on the section taken line 5—5; of FIG. 1

As illustrated in FIGS. 1 and 5, the pivotally movable rollerway sections 15, 15*a* are supported on tracks 18 by means of rollers 19 and are displaceable independently of each other, or together, by means of hydraulic or pneumatic power means 20, 20*a* about a pivot point S laterally in respect of the rolled stock line. For this purpose the piston rods 21, 21*a* of the power means 20, 20*a* are pivotally connected to the rollerway sections 15, 15*a* by means of displacer rods 22 and angle levers 23 which for example are pivotally connected to the longitudinal sides of the rollerway sections 15, 15*a* by way of traction rods 24 and which have length dimensions which decrease towards the cooling beds 16, 16*a*. The rollerway sections 15, 15*a* are followed by cooling beds 16, 16*a*, which are laterally offset relative to the stock lines I and II.

The rollerway sections 15, 15*a* are provided in the usual way with stationary groove sections and with separating and braking means and are pivotally movable about vertical swing axes S at the cooling bed end. The inclination of the stock receiving surfaces of the sections amounts to approximately 10° which is equal to the inclination of the corresponding surfaces of the tipping rollerway sections 5, 5*a* in either of the positions B1 or B2. The stock lengths can therefore be transferred from one rollerway section 5 or 5*a* to another section 15 or 15*a* without any disturbances.

Figure 2:
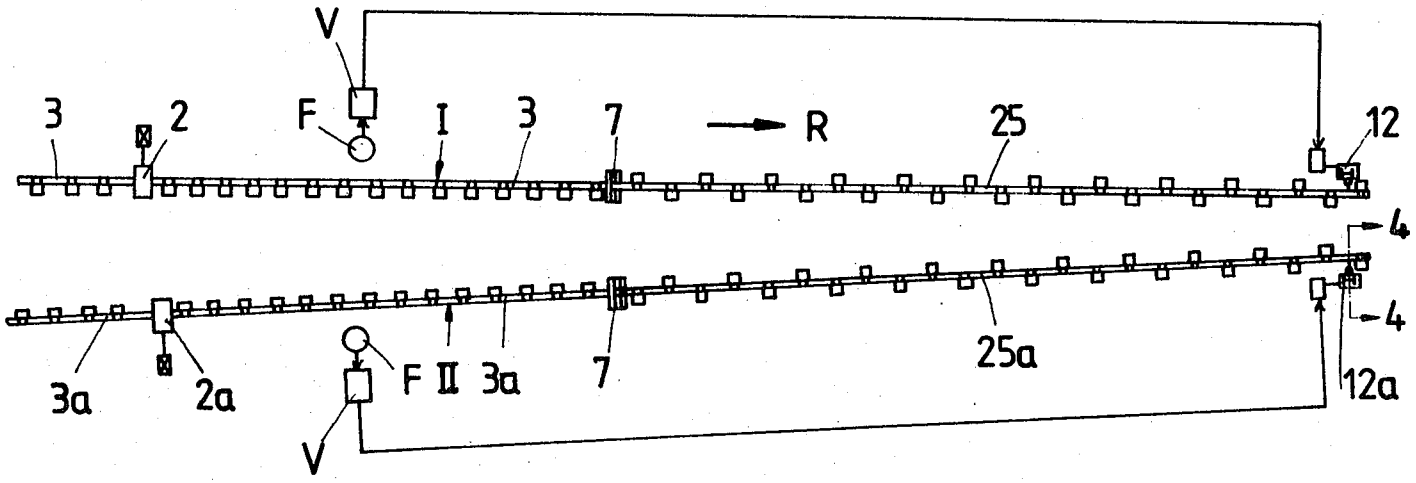
FIG. 2 is a plan view of part of a rolled stock line from an installation forming a second embodiment of the invention.

FIG. 2 illustrates a part of an arrangement of two side-by-side rolled stock lines with relatively long tipping rollerway sections 25, 25*a*. These sections have a length of from approximately 40 to 60 m. The actual length is determined by the cooling bed length and the rolling speed.

Figures 6, 7, 8:
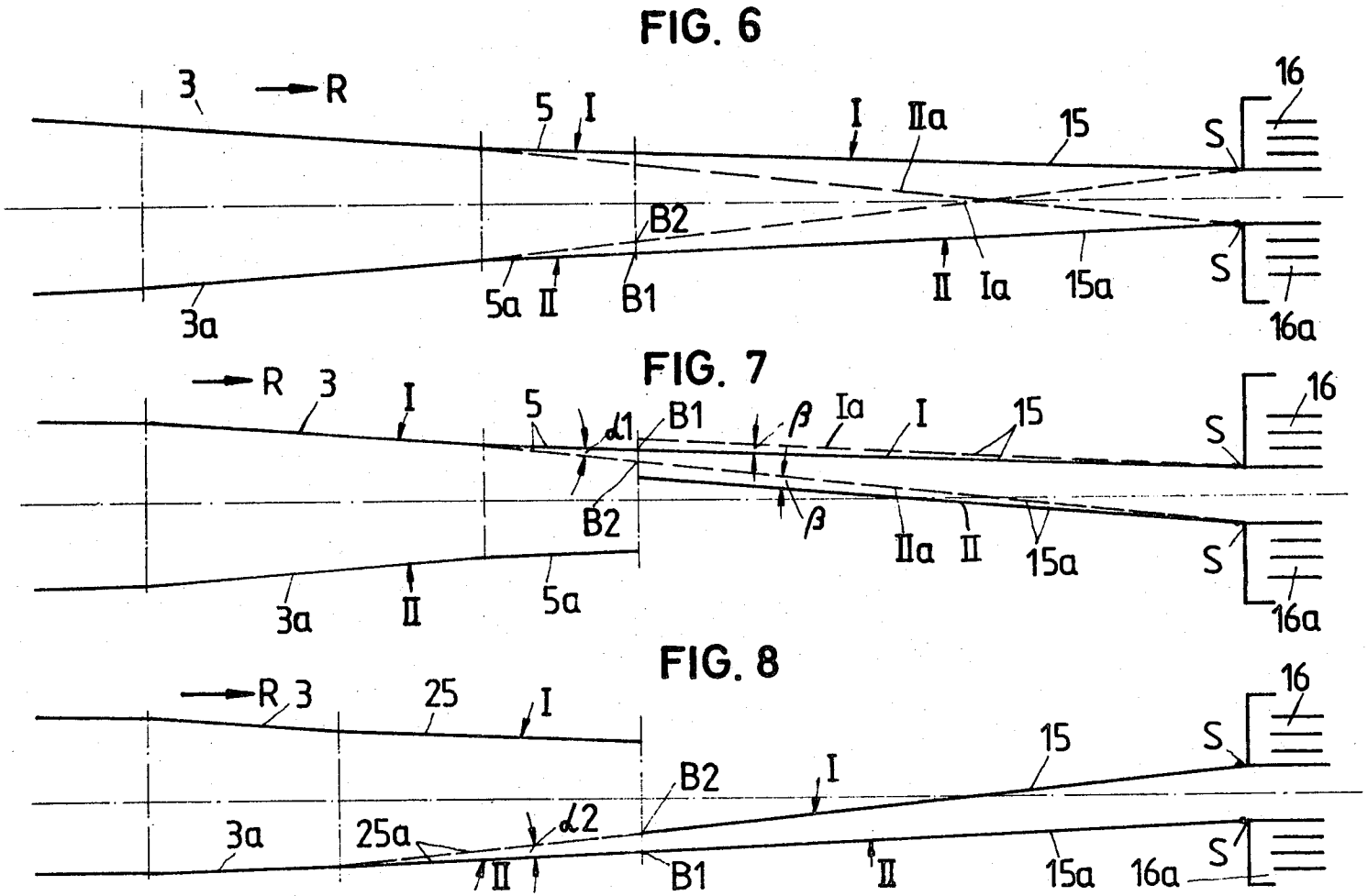
FIG. 6 shows diagrammatically the manner of operation of the installation for two-strand rolling operation.
FIG. 7 shows diagrammatically the manner of operation of the installation for single-strand rolling operation with a relatively short pivotal rollerway section.
FIG. 8 shows diagrammatically the manner of operation of the installation for single-strand rolling operation with a relatively long pivotal rollerway section.

In two-strand rolling operation, lengths of thin flexible rolled stock are conveyed from the rolling mill 1 by way of the rollerway section 3, the tipping rollerway section 5, the rollerway section 15 to the cooling bed 16, and from the rolling mill 1*a* by way of the rollerway section 3*a*, the tipping rollerway section 5*a*, the rollerway section 15*a* to the cooling bed 16*a*, as illustrated in FIGS. 1 and 6.

In a view from above, FIG. 7 illustrates diagrammatically the manner of operation of the installation for single strand rolling operation of thicker relatively bending-resistant stock. The tipping rollerway sections 5 as well as the rollerway sections 15, 15*a* are illustrated in a simplified manner in their various operative positions by full lines and broken lines I, II, and Ia, IIa, respectively. The angles $\alpha 1$ and $\beta$ indicate the deflection angles of the tipping rollerway sections 5 and of the rollerway sections 15, and 15*a* respectively.

In the rolled stock line I the partial lengths travel in the feed direction R along the conveyor rollerway section 3 and the tipping rollerway section 5 which is swung laterally from position B1 to position B2 after each successive stock length or after a number of stock lengths derived from one starting slab. The rollerway section 5 swings through the angle $\alpha 1$ between the operative positions B1 and B2 (illustrated respectively by a full line and a broken line). Prior to the start of operation of the single strand rolling operation, the pivotally movable rollerway section 15 and the pivotally movable rollerway section 15 have both been displaced relative to the positions shown in FIG. 6, into the vicinity of the mean position of the tipping rollerway section 5.

To transfer the stock to cooling bed 16, the rollerway section 15 is moved to the position shown in full lines, and the rollerway section 5 is also in its position shown in full lines. To then transfer stock to the bed 16*a*, both rollerway sections 15 and 5 are moved to their dotted line positions. In order to permit the rollerway sections 15 and 15*a* to be pushed together as closely as possible, the driving motors are arranged mutually offset, as already described and illustrated in FIGS. 1 and 2. At each swing movement of one rollerway section 15, the other rollerway section 15*a* is likewise displaced also by the same angle $\beta$, i.e. by the same amount in the same swing direction.

The control of the displacement drives 12, 20 and 12*a*, 20*a*, is effected by a photocell F which scans the gap between the stock lengths. A time dependent or travelling speed dependent delay member V actuates the displacement drives 12, 20, 12*a*, 20*a* (for single strand rolling operation using the rolled stock line II) and alternate charging of the two cooling beds 16, 16*a*. In single strand rolling operation using the line II, the tipping rollerway section 5*a* is actuated accordingly in the same manner together with the rollerway sections 15, 15*a*.

In a view from above, FIG. 8 illustrates diagrammatically the manner of operation of the installation for single strand rolling operation of thicker relatively bending-resistant profile cross-sections, for example using the rolled stock line II, with a relatively long tipping rollerway section 25, 25*a* as shown in FIG. 2.

The stock lengths are directed from the rolled stock line II to the line I by way of the conveyor rollerway section 3*a* and the tipping rollerway section 25*a* which can be swung through a swing angle $\alpha 2$ into one or the other operative position B1 or B2 in the period of time between successive stock lengths. Since the rollerway sections 15, 15*a* have moved as closely together as possible into the positions II and I prior to the start of operation, additional relative swing movement, as described for FIG. 7, of the rollerway sections 15, 15*a* is unnecessary, since their spacing corresponds already to the swing path of the tipping rollerway section 25*a*. Therefore in this case a partial length can be supplied alternately by way of the line I and the rollerway section 15 to the cooling bed 16, and the next following one by way of the line II and the entry rollerway section 15*a*, to the cooling bed 16*a*. In this case only the displacement drive 12*a* of the tipping rollerway section 25*a* is actuated by the photocell control F. The smooth transfer of the partial lengths from the tipping rollerway section 25*a* to the rollerway section 15 or 15*a* ensures trouble-free operation.

In the same manner, with single strand rolling in the line I, the stock lengths may be transferred alternately to the cooling bed 16 or 16*a*.

The swing path of the tipping rollerway sections 5, 5*a* and 25, 25*a* into the operative position B1 or B2 is of such a length that the inclination of the feed planes on either side of the transfer points between the tipping rollerway sections and the rollerways 15, 15*a* are of the same magnitude at approximately 10°. Thereby reliable guidance of the stock lengths is ensured together with great travelling smoothness at the transfer points.

As may be seen in particular from FIGS. 1, 2, 6, 7 and 8, the rolled stock lines converge towards the cooling beds 16, 16*a* in such a manner that they are always directed to the entry guide of the cooling bed 16*a*, or 16, respectively, of the other line. The rollerway sections 3 and 3*a* are directed towards the entry guides of the cooling bed of the opposite stock line. Also, in particular in single strand rolling operation for thicker bending-resistant stock, impact locations of any kind are avoided thereby in the guidance of the stock lengths for alternate transfer to the one or the other cooling bed.

The construction as a tipping rollerway of the deflectable rollerway section 5, 25 as illustrated and described is a preferred embodiment. However, the rollerway section which is deflectable laterally in respect of the feed direction may alternatively be constructed as a rollerway which is pivotally movable in a horizontal plane and which is pivotal about a vertical axis of rotation into the operative positions B1 and B2, respectively, into line with the respective head ends of the rollerway sections 15, 15*a* by means of the same control.

I claim:

1. In an apparatus for selectively conveying rolled stock of flexible and relatively bending resistant profiled cross-sections of different cross-sectional shape in continuous high grade steel and medium grade steel rolling trains, wherein two mutually approximately parallel conveying lines each convey rolled stock to a respective cooling bed, each conveying line comprising an inlet rollerway and a downstream outlet rollerway having an upstream end and a downstream discharge end, the respective cooling beds being arranged downstream and laterally of the outlet rollerways for receiving rolled stock discharged therefrom, each outlet rollerway having a conveying surface inclined across the conveying direction towards the respective cooling bed and each outlet rollerway being pivotable about said discharge end so that either both cooling beds are charged simultaneously by both inlet rollerways in approximately parallel conveying directions, or one or the other cooling bed is charged by one or the other inlet rollerway, the improvement comprising providing between the inlet rollerways and the outlet rollerways two tipping rollerways each having an upstream end and a downstream end, the upstream end of each tipping rollerway being fixedly aligned with a respective inlet rollerway, each tipping rollerway being swingable selectively into alignment with one or the other outlet rollerway and being constructed with pivotable support means and being provided at said downstream end with means for swinging said downstream end along an arcuate path about a swing axis which is inclined downwardly in the conveying direction, said arcuate path tracing substantially the surface of a cone along which said tipping rollerway is swingable, each tipping rollerway having a conveying surface having substantially the same inclination in the conveying direction as said conveying surface of the respective outlet rollerway when in line therewith for smooth conveyance of stock from the tipping rollerway to the respective outlet rollerway.

2. The apparatus of claim 1, wherein the means for swinging the tipping rollerway are controlled by electrical sensors disposed upstream of the tipping rollerway which sense gaps between lengths of rolled stock and actuate the swinging means via time dependent delay means.

3. Apparatus according to claim 1, wherein the angle of inclination of the conveying surface of the pivotally movable outlet rollerways and of the tipping rollerways is approximately 10° towards the respective cooling bed side from the horizontal in the respective operative position.

4. Apparatus according to claim 1, wherein the upstream ends of the tipping rollerways adjacent the respective inlet rollerways are mounted in stationary support bearings.

5. Apparatus according to claim 1, wherein said inlet rollerways converge towards each other in such a manner that an extension line from each is always directed to the cooling bed of the other rolling line.

6. Apparatus according to claim 1 wherein the tipping rollerways are supported over their length with the conveying surface horizontal on struts which are arranged in a vertical plane and which are pivotally displaceable laterally transverse to the conveying line, said pivotable support means comprising each strut being pivotally mounted at its lower end by means of a pivot mounted on a fixed support member, the rotational axes of said pivots lying along a common downwardly inclined line, and the length of said struts increases over the length of the tipping rollerway in the conveying direction in such a manner that when the tipping rollerway is swung out through a lateral stroke path, a deflection movement occurs on said cone surface the longitudinal axis of which is said common downwardly inclined line of said pivot axes.

7. Apparatus according to claim 6 wherein the pivot axes of the struts of the tipping rollerway are arranged offset in height by the amount of the steady increase of the length of the struts in a step-like manner relative to the plane of the conveying line downwardly in the direction along said common downwardly inclined line.

8. Apparatus as claimed in claim 1, wherein said tipping rollerways are relatively long and said apparatus further comprises means for accurately pivoting the outlet rollerway of one conveying line so that its upstream end is as close as possible to the upstream end of the outlet rollerway of the other conveying line, means for sensing gaps between lengths of rolled stock conveyed along the inlet rollerway of said other conveying line and swinging said tipping rollerway of said other conveying line alternately between said outlet rollerways for alternately conveying the rolled stock lengths to the one and the other cooling bed.

9. Apparatus as claimed in claim 1, wherein said tipping rollerways are relatively short and said apparatus further comprises means for pivoting the outlet rollerway of one conveying line so that its upstream end is as close as possible to the upstream end of the outlet rollerway of the other conveyling line, means for sensing gaps between lengths of rolled stock conveyed along the inlet rollerway of said other conveying line and for alternately swinging said tipping rollerway of said other conveying line and pivoting said one or other outlet rollerway into alignment, for alternately conveying rolled stock lengths to one or the other cooling bed, and for simultaneously pivoting said other or one outlet rollerway by the same angle of pivoting and in the same direction of pivoting as the said one or other outlet rollerway.

* * * * *